US007127857B2

(12) United States Patent
Randjelovic

(10) Patent No.: US 7,127,857 B2
(45) Date of Patent: Oct. 31, 2006

(54) SUBFLOOR ASSEMBLY FOR ATHLETIC PLAYING SURFACE HAVING IMPROVED DEFLECTION CHARACTERISTICS

(75) Inventor: Erlin A. Randjelovic, Crystal Falls, MI (US)

(73) Assignee: Connor Sports Flooring Corporation (US)

( * ) Notice: Subject to any disclaimer, the term of this patent is extended or adjusted under 35 U.S.C. 154(b) by 376 days.

(21) Appl. No.: 10/235,226

(22) Filed: Sep. 4, 2002

(65) Prior Publication Data

US 2004/0040242 A1 Mar. 4, 2004

(51) Int. Cl.
*E04B 5/43* (2006.01)

(52) U.S. Cl. ..... 52/403.1; 52/480; 52/478; 52/481.1; 472/92

(58) Field of Classification Search ..... 52/403.1, 52/480, 478, 745.2, 746.1, 481.1, 412, 413, 52/774, 585.1, 506.06; 472/92, 136
See application file for complete search history.

(56) References Cited

U.S. PATENT DOCUMENTS

| | | | | | |
|---|---|---|---|---|---|
| 498,344 | A | | 5/1893 | Williams | |
| 1,818,298 | A | | 8/1931 | Bowman | |
| 1,908,639 | A | | 5/1933 | Fisher | |
| 1,968,246 | A | * | 7/1934 | Coleman | 52/506.01 |
| 2,005,030 | A | * | 6/1935 | Geisinger | 52/384 |
| 2,027,133 | A | * | 1/1936 | Weinstein | 52/413 |
| 2,088,625 | A | * | 8/1937 | Wailace | 52/774 |
| 2,263,895 | A | | 11/1941 | Larsen | |
| 2,573,482 | A | * | 10/1951 | Peik | 52/443 |
| 2,746,097 | A | * | 5/1956 | Tofani, Jr. | 52/403.1 |
| 2,956,653 | A | | 10/1960 | Liskey, Jr. | |
| 3,110,131 | A | * | 11/1963 | Nelson | 52/396.04 |
| 3,462,899 | A | * | 8/1969 | Sherman | 52/309.6 |
| 3,542,322 | A | | 11/1970 | Dvorin | |
| 3,633,855 | A | * | 1/1972 | Nell | 248/694 |
| 4,003,174 | A | * | 1/1977 | Kotcharian | 52/415 |
| 4,028,858 | A | * | 6/1977 | Rehbein | 52/384 |
| 4,325,546 | A | * | 4/1982 | McMahon et al. | 472/92 |
| 4,338,758 | A | * | 7/1982 | Hagbjer | 52/745.2 |
| 4,420,135 | A | | 12/1983 | Munz | |
| 4,694,627 | A | * | 9/1987 | Omholt | 52/390 |
| 4,869,479 | A | | 9/1989 | Colonel et al. | |
| 5,016,413 | A | * | 5/1991 | Counihan | 52/391 |
| 5,253,464 | A | * | 10/1993 | Nilsen | 52/508 |
| 5,497,590 | A | * | 3/1996 | Counihan | 52/385 |
| 5,566,519 | A | * | 10/1996 | Almaraz-Miera | 52/592.1 |
| 5,671,575 | A | * | 9/1997 | Wu | 52/403.1 |
| 5,682,724 | A | | 11/1997 | Randjelovic | |

(Continued)

FOREIGN PATENT DOCUMENTS

| | | |
|---|---|---|
| DE | 268762 | 1/1927 |

(Continued)

*Primary Examiner*—Phi Dieu Tran A
(74) *Attorney, Agent, or Firm*—Gary R. Jarosik

(57) ABSTRACT

A floor support assembly including first and second subfloors is disclosed. The first subfloor is supported over a substrate by a plurality of pads. Each pad is housed in a corresponding recess formed in the first subfloor. Each recess includes a ridge that is in contact only with its respective pad when the floor is in a lightly loaded position. In a more aggressively athletically loaded state, the pad contacts the ridge and a portion of the top of the recess. In a non-athletic fully loaded state, the first subfloor plate near the load rests on the substrate. The second subfloor is located above the first subfloor and is supported by the first subfloor. A method of installing the same is also disclosed.

11 Claims, 7 Drawing Sheets

U.S. PATENT DOCUMENTS

| | | | | | |
|---|---|---|---|---|---|
| 5,778,621 | A | | 7/1998 | Randjelovic | |
| 6,023,900 | A | * | 2/2000 | Stoehr et al. | 52/403.1 |
| 6,122,873 | A | * | 9/2000 | Randjelovic | 52/403.1 |
| 6,158,915 | A | * | 12/2000 | Kise | 403/309 |
| 6,164,031 | A | * | 12/2000 | Counihan | 52/480 |
| 6,230,460 | B1 | * | 5/2001 | Huyett | 52/403.1 |
| 6,256,957 | B1 | * | 7/2001 | Kelly | 52/413 |
| 6,363,675 | B1 | * | 4/2002 | Shelton | 52/403.1 |
| 6,711,864 | B1 | * | 3/2004 | Erwin | 52/582.1 |

FOREIGN PATENT DOCUMENTS

| | | | | | |
|---|---|---|---|---|---|
| DE | 3838733 | A1 | | 5/1990 | |
| EP | 0 455 616 | A1 | | 11/1991 | |
| FR | 2671824 | | * | 7/1992 | 52/403.1 |

* cited by examiner

SUBFLOOR ASSEMBLY FOR ATHLETIC PLAYING SURFACE HAVING IMPROVED DEFLECTION CHARACTERISTICS

FIELD OF THE INVENTION

This invention generally relates to a subfloor assembly that is constructed to support a top sports floor surface. More specifically the subfloor construction is designed to provide high resiliency and to isolate athletic impacts on the sports floor surface. The invention further provides significant stability to maintain constant uniformity of play.

BACKGROUND

Sports floors provide a high level of resiliency and shock absorption, and also preferably provide uniform play and safety to all participants. It is also preferred that sports floor systems maintain stability especially under changing environmental conditions.

A common sports floor system can be described as an upper playing surface attached to a subfloor structure, which is supported by resilient mounts. Often the upper playing surface is constructed of hardwood flooring. Sports floor systems such as these are disclosed in U.S. Pat. No. 5,365,710 to Randjelovic et al, entitled "Resilient subfloor pad".

The resilient mounts such as those described in the Randjelovic patent are widely used in support of subfloor construction. The resilient mounts provide deflection as athletic impacts occur on the surface of the system. Most typically the resilient mounts are attached to the underside of subfloor plates such as plywood sheeting. The subfloor structure supported by the resilient mounts is not limited to plywood plate components and may include other components such as softwood sleepers or other suitable support material.

The sports floor systems previously described offer shock absorption to athletic participants. However, as these floor systems are free floating, there is no provision to assure proper contact of the resilient mounts to the supporting substrate. Free floating systems such as these, when installed over uneven substrates, may provide non-uniform deflection under athletic load, causing uneven shock absorption under impact. For example, the non-uniform reflection of the basketball off the floor creates a condition typically referred to as dead spots.

It would be desirable to have a floating floor system that overcomes the limitations of the floors of the prior art as well as improving the load distribution and shock absorption characteristics.

SUMMARY

In one aspect of the present invention, a resilient floor system is disclosed. The floor system includes a floor with an athletic surface supported by an upper subfloor. The upper subfloor is supported by a lower subfloor. The lower subfloor includes plates having at least one recess disposed along a long axis of each plate. The recess includes a center ridge. The lower subfloor is supported over a substrate by pads located in each of the recess. Each pad is coupled to the underside of the lower subfloor and extends between the substrate and lower subfloor to create a space. The lower subfloor floats on the pads over the substrate when the floor is in an unloaded state.

In another aspect of the present invention, a floor support assembly includes first and second subfloors. The first subfloor is supported over a substrate by a plurality of pads. The second subfloor is located above the first subfloor and is supported by the first subfloor. Each pad is housed in a corresponding recess formed in the first subfloor. Each recess includes a ridge that is in contact with its respective pad when the floor is in an unloaded state. Light and initial athletic loads focus deflection of the pads below the center ridge providing shock absorption for individual players and small participants. Significant athletic loads such as a concentration of players or larger athletes create contact of the resilient pad across the full width of the subfloor recess, thus providing support and shock absorption for multiple players and larger participants. In the fully loaded state, such as below movable bleachers, portable basketball goals, or other significantly non-athletic loads, the first subfloor rests on the substrate. The subfloor resting fully on the substrate supports loads without stresses on the systems structural components, and prevents full compression of the resilient pads that are housed in the subfloor recess.

In another aspect of the present invention, a method of installing a resilient sports floor is disclosed. A first subfloor section including a plurality of grooved recesses housing a pad along the long axis of the groove is placed on a substrate. One surface of the pad contacts the substrate and an opposed second surface contacts a ridge in the recess. A space is formed between substrate and the bottom of the first subfloor. A second subfloor is placed on the first subfloor. An athletic floor is placed on the second subfloor.

A more complete appreciation of the present invention and its scope may be obtained from the accompanying drawings that are briefly described below, from the following detailed descriptions of presently preferred embodiments of the invention and from the appended claims.

BRIEF DESCRIPTION OF THE DRAWINGS

The invention may be more completely understood in consideration of the following detailed description of various embodiments of the invention in connection with the accompanying drawings, in which.

DETAILED DESCRIPTION

In the following description of preferred embodiments of the present disclosure, reference is made to the accompanying drawings that form a part hereof, and in which is shown by way of illustration specific embodiments in which the disclosure might be practiced. It is understood that other embodiments may be utilized and structural changes may be made without departing from the scope of the present invention.

In general, the present disclosure discusses a subfloor for use in a floor system. The subfloor is a resilient, multi-layer subfloor that has excellent shock absorption and load distribution characteristics and other desirable properties.

Figure 1:
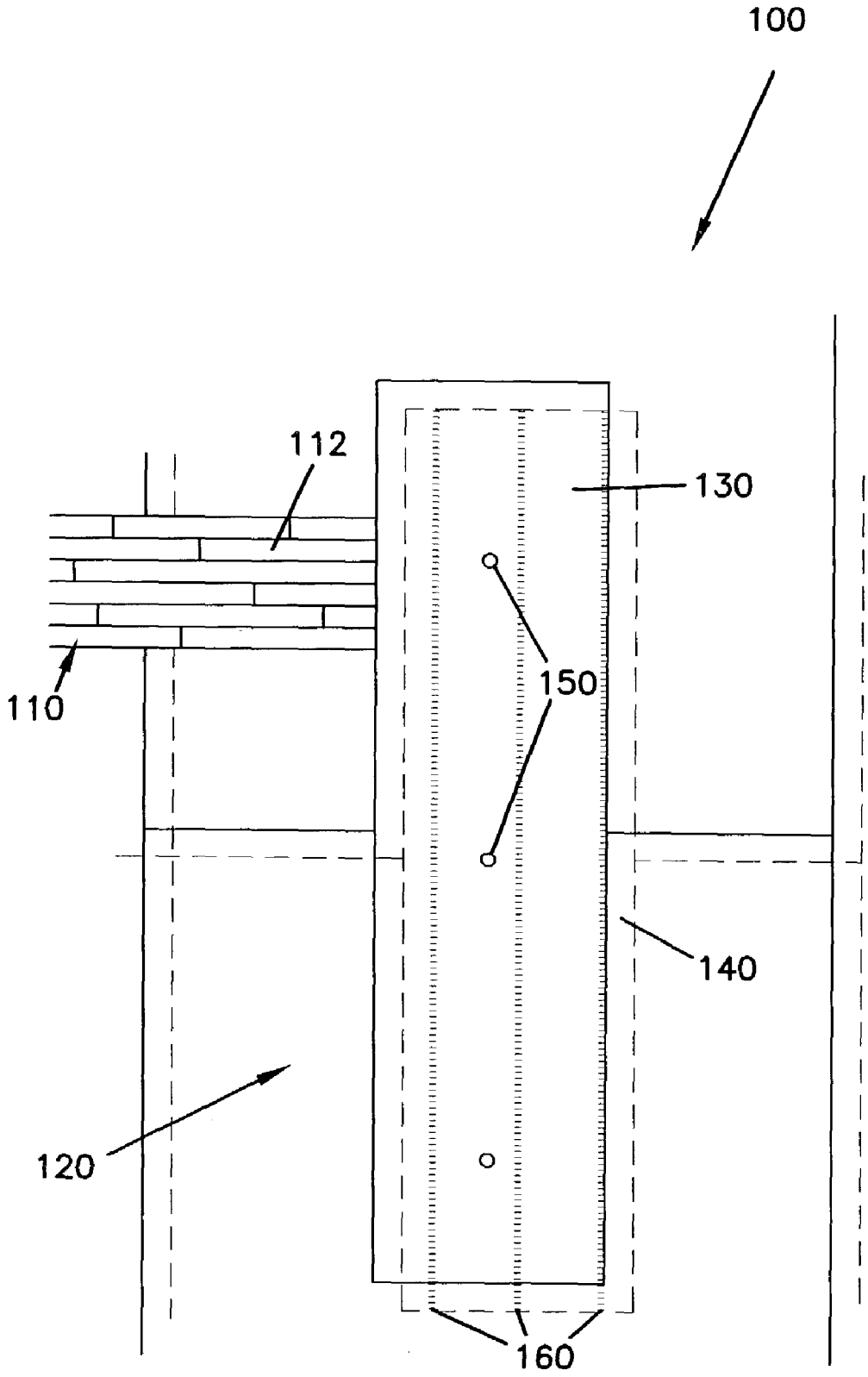
FIG. 1 is a top view of a portion of a floor system employing an exemplary embodiment of a subfloor according to the present disclosure.

FIG. 1 is a top view of a subfloor assembly 120 usable in a floor system 100. The subfloor assembly 120 has many industrial applications, but is especially suited for sports floors that include a subfloor for supporting and distributing loads.

In the example embodiment shown, the floor system 100 includes a floor 110 supported by a subfloor assembly 120. The floor 110 is typically used for sporting events, for example, basketball or volleyball. The floor 110 includes a playing surface 112 that is subjected to various loads and forces, for example, forces exerted by players, bleachers, equipment, crowds, and other activities occurring on the floor 110.

The subfloor assembly 120 is supported by resilient pads 160, which rest on a substrate 102. The subfloor assembly 120 includes an upper subfloor 130 and a lower subfloor 140. The upper subfloor 130 is coupled to the lower subfloor 140 by means of mechanical fasteners, for example, staples, screws, or nails. The flooring 112 is typically attached to the subfloor assembly 120 by means of nails, staples, or adhesive. One of skill in the art will recognize that methods and apparatus for floor 110 attachment to the subfloor assembly 120 are well known, including nailing, stapling, and gluing. The particular method or technique depends on many factors, including the primary use and purpose of the floor 110, and such methods and apparatus are not the considered part of the focus of the present disclosure.

Figure 2:
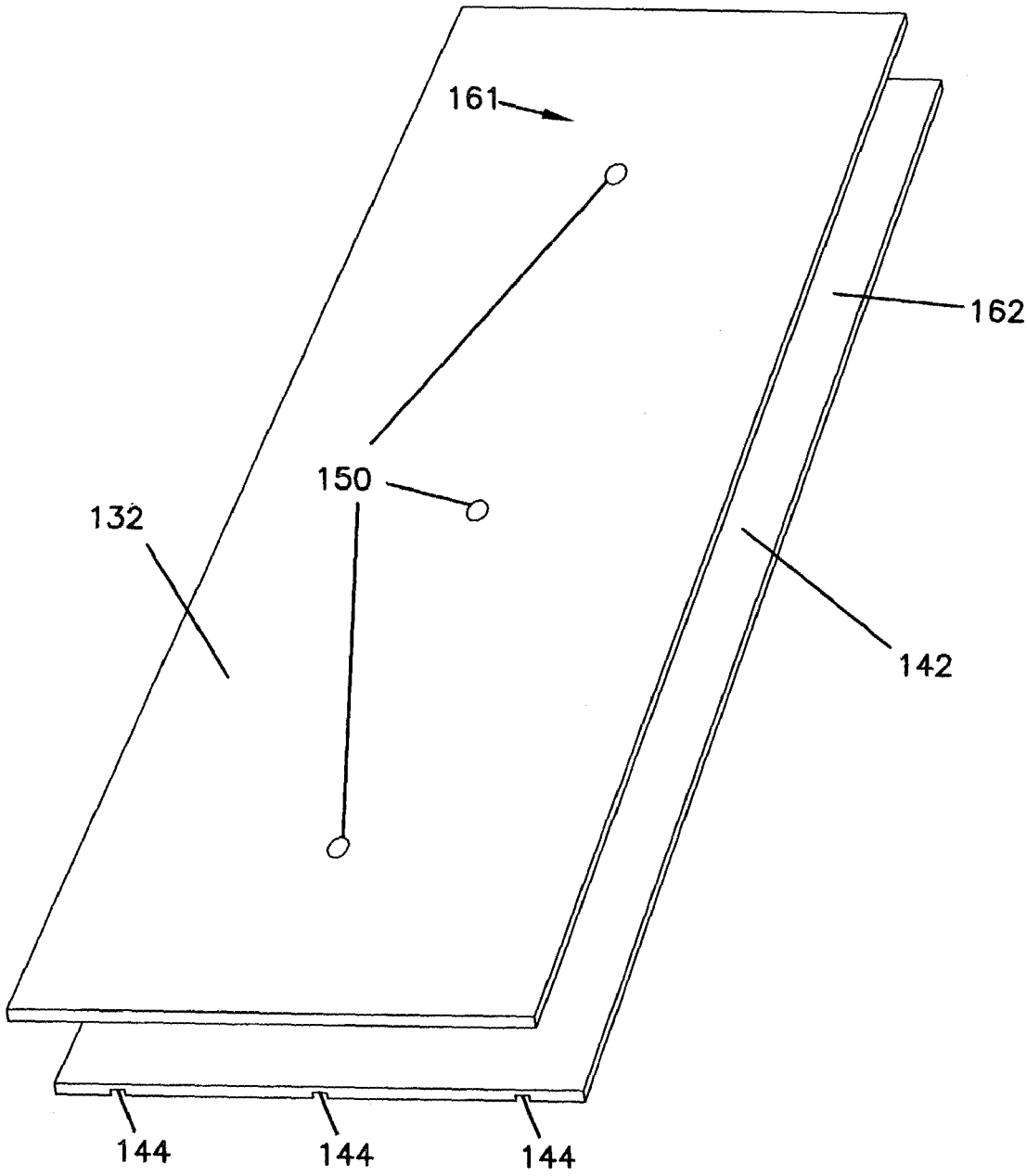
FIG. 2 is a perspective view of an example embodiment of a portion of a subfloor assembly usable with the floor system of FIG. 1 according to the present disclosure.

FIG. 2 depicts an assembled subfloor section 161 consisting of an upper plate 132 that provides a section of the upper subfloor 130, and a lower plate 142 that provides a section of the lower subfloor 140. The lower plate 142 includes a plurality of recesses 144 on the underside. The upper plate 132 and lower plate 142 are preferably offset to form assembled subfloor sections 161 that provides a shoulder 162 along two edges. The upper plate 132 is preferably attached to the lower plate 142 by means of staples, nails, or adhesive. The assembled subfloor sections 160 are formed in what are referred to as a shiplap design. Elongated edge of upper plate 132 is preferably aligned over outer recess 144 where located on underside of lower plate 142.

Formation of the subfloor 120 includes integration of assembled subfloor sections 161 whereby protruding edges of upper plates 132 rest on and are attached to shoulder 162 areas of lower plates 142. Subfloor 120 assembly preferably includes alignment of protruding elongated edges of upper plates 132 over first recess 144 in a manner that provides support from resilient pads 160. Subfloor sections 161 are preferably staggered, as shown in FIG. 1. Attachment of upper plates 132 to lower plates 142 of adjacent subfloor sections 161 is preferably provided using staples, nails, or adhesive, or a combination of thereof. The staggering, or offset, allows for a more even distribution of forces from the floor 110 to the subfloor assembly 120 during use of the floor 110, compared to when the subfloor sections 161 are not staggered. In addition, staggering subfloor sections provides added integrity of the full floor system 100.

The preferred material for the plates is plywood, but other suitable materials can also be used, for example, composite board and other engineered wood products, the material selection being known to one of skill in the art.

The floor 110 and subfloors 130, 140 can be made from a variety of materials. One of skill in the art will recognize that the materials selected for the floor 110 and subfloor assembly 120 depend of the nature of the use of the floor system 100 and are not considered a focus of the present disclosure. Preferably, the floor 110 is made from wood species such as maple, oak, birch, or others commonly used for manufacturing wood flooring. The floor 110 surfaces may also consist of synthetic materials, for example, vinyl, rubber, urethanes, or other suitable materials. Non-wooden surfaces are most preferably attached to the subfloor 120 using an adhesive. Upper and lower subfloor plates 132, 142 are preferably made from plywood or engineered wood products.

Referring to FIGS. 2 and 3A–3D, the lower subfloor 140 of the subfloor sections 161 includes one or more recesses 144 along a long axis of the lower plates 142, though the recess orientation can vary depending on the particular conditions, and can be, for example, along a short axis of the plate 142. A ridge 146 is located in each recess 144. The ridge 146 contributes to the load distribution of the present disclosure. Preferably, each recess 144 includes a corresponding ridge 146 centered across the width of the recess Wrr. The ridge 146 preferably also runs the entire length of its corresponding recess 144. Recesses 144 may include multiple ridges rather than a single center ridge 146, and multiple ridges may be provided within the same recess 144. Multiple ridges may be provided in different vertical dimensions within the same recess 144 to enhance floor system 100 performances. Ridges 146 may also be manufactured of assorted shapes, for example, arced, triangular, and other designs that impact the resilient pad in a manner to distribute forces.

Each recess 144 houses a pad 160, which also contributes to the load distribution and shock absorption characteristics of the floor assembly of the present disclosure. Preferably, the pad is made from a material having a high strength as well as a resilient elastic modulus, for example, rubber, foam, urethane, or other suitable materials. Preferably, the pad is made from combination rubber and foam mixture.

More preferably, the combination foam and rubber mixture is 50 percent foam and 50 percent rubber.

In the example embodiment shown, each pad 160 has a width Wp approximately equal to the width Wrr of the recess 144. Referring to FIGS. 1 and 2, the pads 160 are arranged in rows perpendicular to the flooring 112 direction. The pads 160 rest on the substrate 102 as shown in FIGS. 3A–3D. The resilient pads 160 align in the recesses 144 of the lower plate 142 and support subfloor assemblies 120. Preferably, the pads 160 are affixed to the underside of the ridges 146 by adhesive. The resilient pads 160 can also be coupled to the surface of the substrate 102. As used herein, the term "coupled" means any structure or method that may be used to provide connecting between two or more members or elements, which may or may not include a direct physical connection between the two elements.

Referring to FIGS. 3A–3D, the load carrying and distribution of the resilient floor system 100 of the present disclosure is illustrated. In an unloaded mode, the pad 160 (or pads) is uncompressed and supports the subfloor. An advantage of non- or slightly deflected resilient pads is that the floor 110 has excellent shock absorption qualities, available tending to reduce the chance of traumatic or cumulative stress related injuries during athletic impacts. In the mode illustrated in FIG. 3A, the load is principally carried by the pad 160 contacting the ridge 146 in the recess 144 of the lower subfloor 140.

Figure 3A:
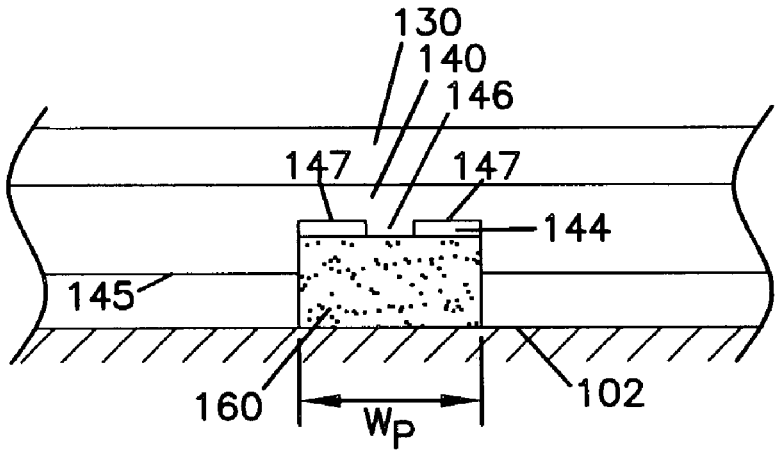
FIG. 3A is a cross-sectional view of a floor system of the same type as shown in FIG. 1, with the subfloor in an unloaded position according to the present disclosure.
Figure 3B:
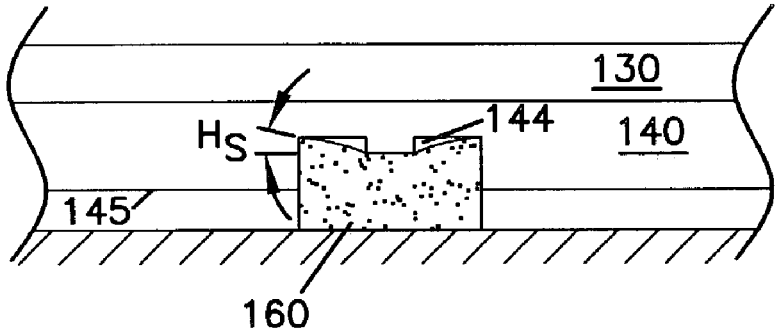
FIG. 3B is a cross-sectional view of the floor system of FIG. 3A with the subfloor in a partially loaded position according to the present disclosure.

Referring to FIG. 3B, as initial and/or light athletic loads occur on the floor 110, the ridge 146 deflects the pad 144 in and near the contact region there between. The load deflects the pad 144 principally along the ridge 146. In this load-bearing mode, the floor system 100 is still floating above the surface 104 of the substrate 102, thus retaining much of its desirable load distribution and shock absorption qualities.

Figure 3C:
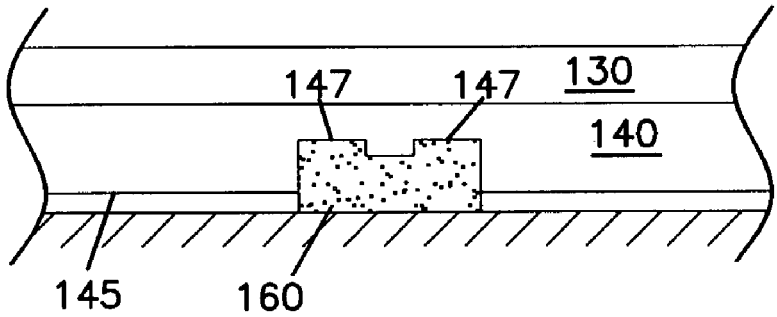
FIG. 3C is a cross-sectional view of the floor system of FIG. 3A with the subfloor being more heavily loaded than in FIG. 3B according to the present disclosure.

Referring to FIG. 3C, as the load on the floor 110 is further increased, the pad 160 continues its deflection or compression until the pad 160 is fully in contact with the ridge 146 and also in contact with faces 147 of the recess 144 on either side of the pad 160. In this mode, the load is distributed over a larger area of the pad 160. Even under the heavier loads, the floor system 100 still floats over the surface 104 of the substrate 102, thus still retaining much of its desirable load distribution and shock absorption qualities, even under the heaviest of athletic loads.

Figure 3D:
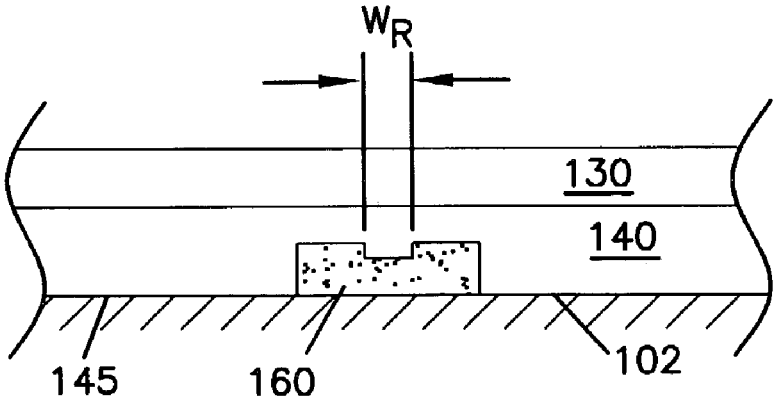
FIG. 3D is a cross-sectional view of the floor system of FIG. 3A with the subfloor in a fully loaded position according to the present disclosure.

While it is desirable that the floor system be kept floating when athletic activities are taking place, if the pads 160 are sized such that the floor system 120 floats carrying any load, no matter how heavy, the result is that the floor 110 will not have the desired resilient characteristics for optimal use. For example, floating the floor system 100 when supporting very heavy loads, such as bleachers or maintenance equipment, would require very stiff pads. This would reduce the efficacy of load distribution and shock absorption of the floor 110 when absorbing lighter athletic loads. To accommodate all such loads, preferably the pads 160 are sized and manufactured of preferred material so that bottom 145 of the lower subfloor 140 rests on the surface 104 of the substrate 102 when very heavy loads are applied. Referring to FIG. 3D, shown in the heavily loaded mode, when a pad 160 is fully loaded, the pad 160 deflects until the bottom surface 145 of the lower subfloor 140 is in contact with the surface 104 of the substrate 102. The entire load is then carried by the substrate 102. An advantage of this arrangement is that the pads 160 are not completely deformed, thereby not carrying the entire load when the floor 110 is bearing the heaviest loads. This reduces the chance that the pads 160 are deformed past their elastic limit and also reduces the permanent deformation of the pads 160, which can decrease the floor system 100 efficacy over repeated use. Further, this feature protects subfloor 120 and floor 110 components from stresses that would otherwise occur without the support of the surface 104 of the substrate 102.

Referring to FIGS. 3A–3D, for a given recess 144 width Wr and pad 160 width Wp, the load distribution and shock absorption characteristics are a function of the width Wr of the ridge 146 relative to the width of the recess Wr. The wider the ridge 146 is relative to the recess 144, the less the deformation is of the floor 110 for a given load. Stated another way, increasing the width Wr of the ridge 146 relative to the width Wrr of the recess 144, also increase the stiffness of the floor 110. Preferably, the widths Wp, Wrr of the pad 160 and the recess 144 are both 1.0 inch, with pad 160 thickness of 9/16". A preferred arrangement provides three 96" long resilient pad 160 sections for a 24"×96" subfloor plate 142. The width Wr of the ridge 146 for the above-described plate is between 0.25 inches and 0.75 inches, and more preferably is 0.025 inches. The height of the ridge 146 also affects the performance of the floor system 100. Preferably, when the recess 144 is about 1.0 inch wide, and the width of the ridge 146 is between 0.25 and 0.75 inches, the height of the ridge 146 is between 0.0625 inches and 0.25 inches. More preferably, the height of the ridge 146 is about 3/32 inches.

A method for installing a flooring system 100 according to the present invention is also disclosed. Subfloor sections 161 are pre-manufactured as shown in FIG. 2. The subfloor sections 161, as previously described, include an upper plate 132 and lower plate 142 offset in a manner to create subfloor plate shoulders 162. Subfloor plates 132 and 142 are preferably attached using staples, and can also be attached using nails, adhesive, or other suitable fastening methods. Subfloor sections 161 include machined recesses 144 for placement and attachment of resilient pads 160 prior to placement on substrate 102. Subfloor sections include anchor pockets 150, as well as anchor clips 155, and rubber bushings 154 detailed in FIGS. 4A–4B–5. The preferred assembly of subfloor sections 161 includes alignment of upper and lower plates 132 and 142 prior to machining anchor pockets 150 through both upper and lower plates 132 and 142. Anchor clips 155 are positioned between plates 132 and 142 as shown in FIG. 4B prior to attachment of upper plate 132 to lower plate 142. A center hole 159 is provided in the lower section 157 of the anchor clip 155. The center hole 159 can accommodate a rubber bushing 154 or other insulating component to prevent friction of the concrete anchor 152 and anchor clip 155. Manufactured subfloor sections 161 are preferably positioned in a staggered pattern as shown in FIG. 1. Protruding edges of upper plates 132 extend to rest on and attach to subfloor plate shoulders 162 and are most typically attach using adhesive and mechanical fasteners such as staples or nails.

Figure 4A:
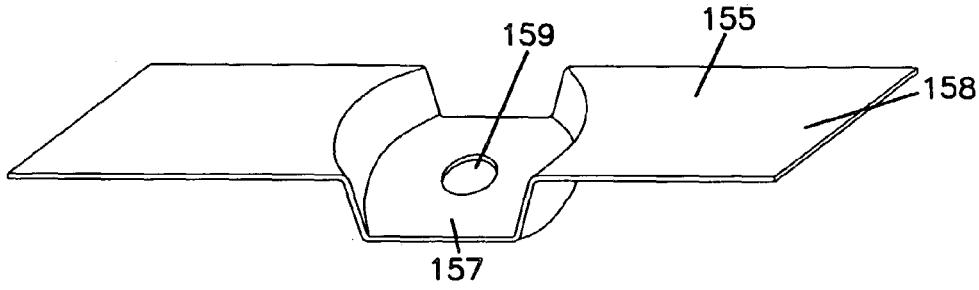
FIG. 4A is a perspective view of an example embodiment of an anchor clip useful in installing the subfloor of FIG. 1 according to the present disclosure.
Figure 4B:
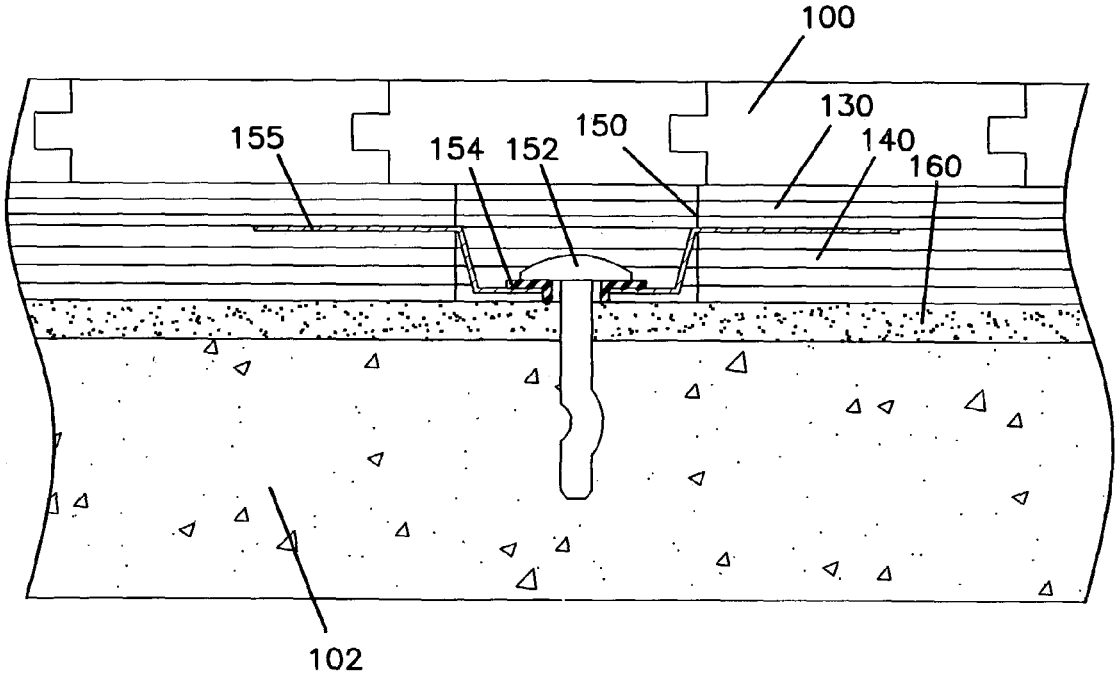
FIG. 4B is a cross-sectional view taken along a first axis of a floor system illustrating an example embodiment of an anchoring arrangement for a subfloor according to the present disclosure.
Figure 4C:
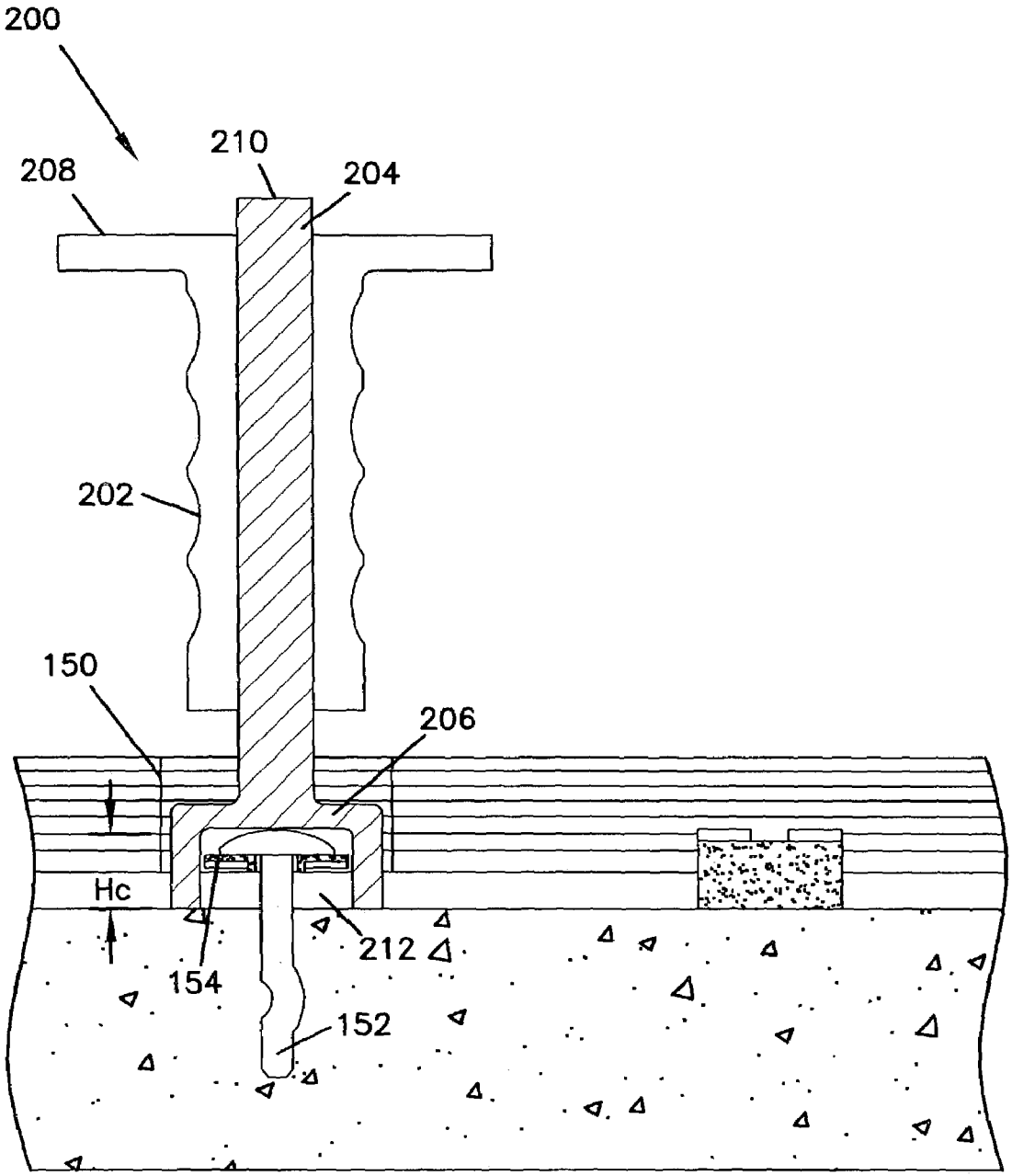
FIG. 4C is a cross-sectional view taken along a second axis of the floor system of FIG. 4B illustrating an example embodiment of an anchoring arrangement for a subfloor according to the present disclosure.
Figure 5:
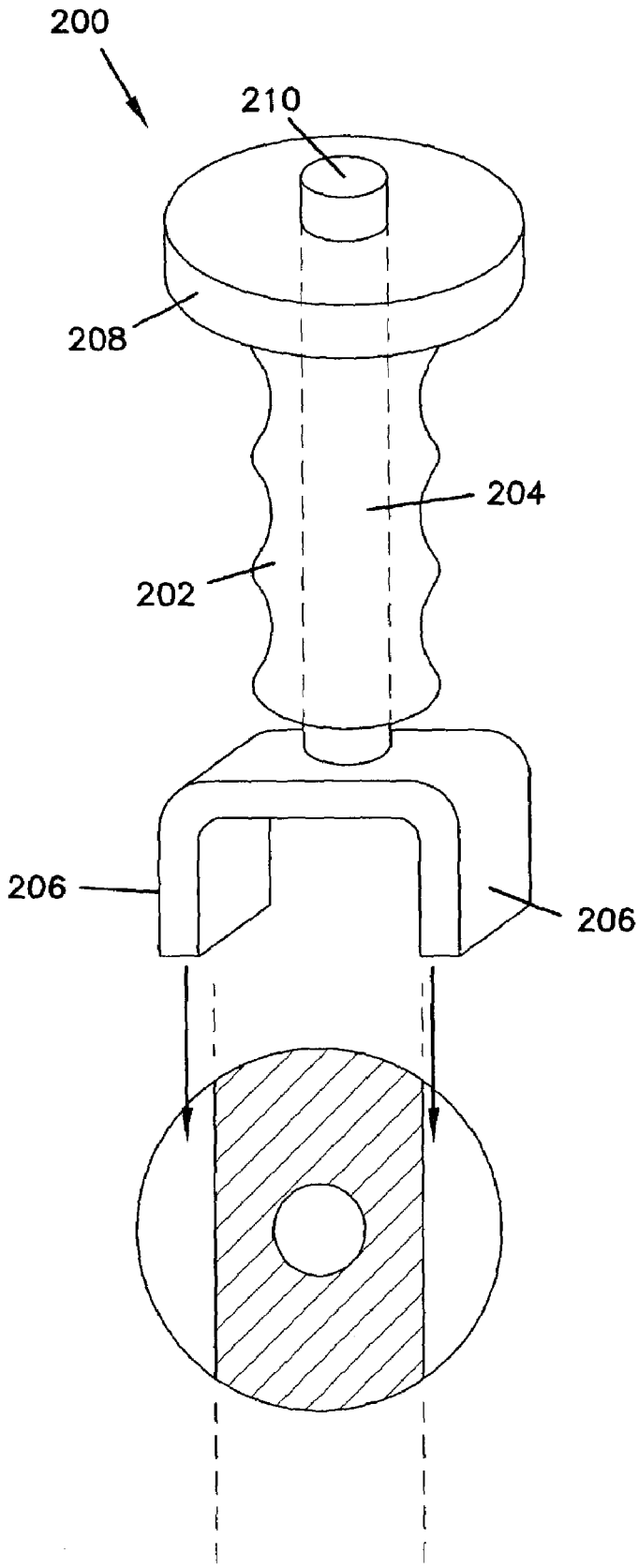
FIG. 5 is a perspective view of a drive tool that can be used to install the subfloor according to the present disclosure.
Figure 7:
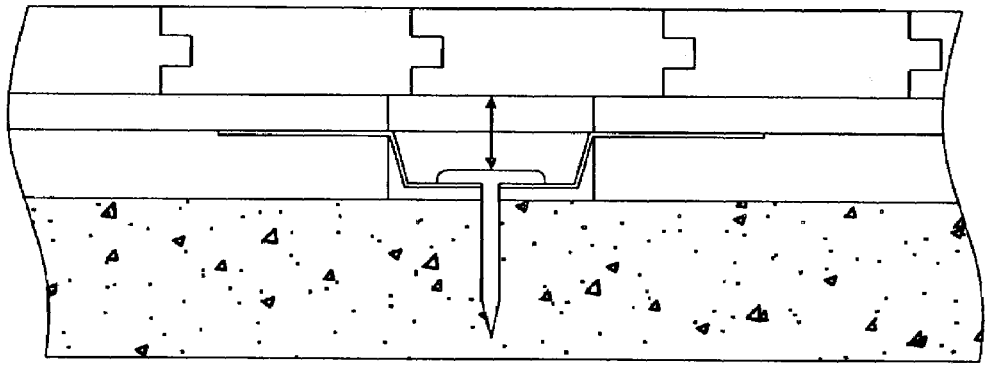
FIG. 7 is a close up view of the an anchoring arrangement illustrated in FIG. 4B according to the present disclosure While the invention is amenable to various modifications and alternative forms, specifics thereof have been shown by way of example in the drawings and will be described in detail. It should be understood, however, that the intention is not to limit the invention to the particular embodiments described. On the contrary, the intention is to cover all modifications, equivalents, and alternatives falling within the spirit and scope of the invention.

Referring to FIGS. 4A–4C, an anchoring arrangement and tool for using the same with a subfloor of the present disclosure are described. Installation of subfloor sections 161 as described form a continuous integrated subfloor 120 that includes a preferred anchorage method to the substrate 102. The subfloor 140 includes a plurality of anchor pockets 150. Each anchor pocket includes a holding device, in this example embodiment an anchoring clip 155, for securing the subfloor 120 to the substrate 102. Referring to FIGS. 4A and 4B, shown is an example embodiment of an anchor clip 155 that can be used for securing the subfloor 120 to the substrate 102. The anchor clip 155 includes a lower portion 157 and an upper portion 158. The lower portion is preferably seated slightly higher than the underside of the lower subfloor plate 142. The flanged upper portions 158 are held in position as the upper and lower plates 132, 142 are secured together during the manufacturing process. Anchor pockets 150 provided in the subfloor 120 include pre-installed anchor clips 155 with inserted rubber bushings 154. Preferably, the bushing also includes a shoulder 153 that centers the bushing in the hole 159, with the bottom edge of the bushing shoulder 153 aligning rather evenly with the underside of the lower plate 142. Alignment of the bushing shoulder 153 in this manner allows full deflection of the subfloor 120 without pressing the bushing shoulder 153 between the underside of the anchor clip section 157 and top of the substrate 104.

Placement of concrete anchors 152 is accomplished by drilling into what is most commonly a concrete substrate 102 with the appropriate drill size in relation to the concrete anchor 152 dimension. Each concrete anchor 152 is inserted through the rubber bushing 154 and driven to the correct depth into the substrate 102.

To assist in the installation of the floor system of the present disclosure, an anchor-driving tool 200 is also disclosed. The tool includes a strike surface 210, legs 206, and a body 204 extending between the strike surface 210 and legs 206. In the example embodiment shown, the tool also includes a grip 202 and a hand guard 208. The legs form a cavity 212 with a height Hc. The height Hc of the cavity 212 is set to limit the driving depth of the concrete anchor 152 into the substrate 102 so that the pads 160 will not be compressed when the subfloor 120 is secured over the substrate.

The tool 200 of the present disclosure is used as described hereinafter when the subfloor 120 is placed and assembled over the substrate 104. Concrete anchors 152 are initially hammer driven until the underside of the anchor head is in near contact with the top of the rubber bushing 154. With the clip 155 properly positioned, the legs 206 of the tool 200 are positioned to straddle the bottom portion 156 of the clip 155 such that the head of the fastener 152 is in contact with the tool 200 at the top of the cavity 212. The fastener 152 can then be driven into the surface 104 of substrate 102 using a hammer or other implement to create a driving force on the strike surface 210 of the tool 200. The fastener 152 is driven into the substrate 102 until the legs 206 of the tool 200 contact surface 104 of the substrate 102. In this manner, the subfloor 120 is installed while preventing or greatly limiting compression of the ridges 146 into the resilient pads 160.

In the preferred use of the invention the flooring surface 110 such as hardwood flooring 112 is attached to the subfloor assembly 120 by means of staples, nails, adhesive, or other suitable methods. The described anchor pockets 150 and anchor clips 155 are designed in a manner and dimension to prevent contact between the top of the concrete anchor and the underside of the flooring material 110 at any time especially when loads are significant to create contact between the underside of the subfloor plates 142 and surface 104 of the substrate.

Figure 6:
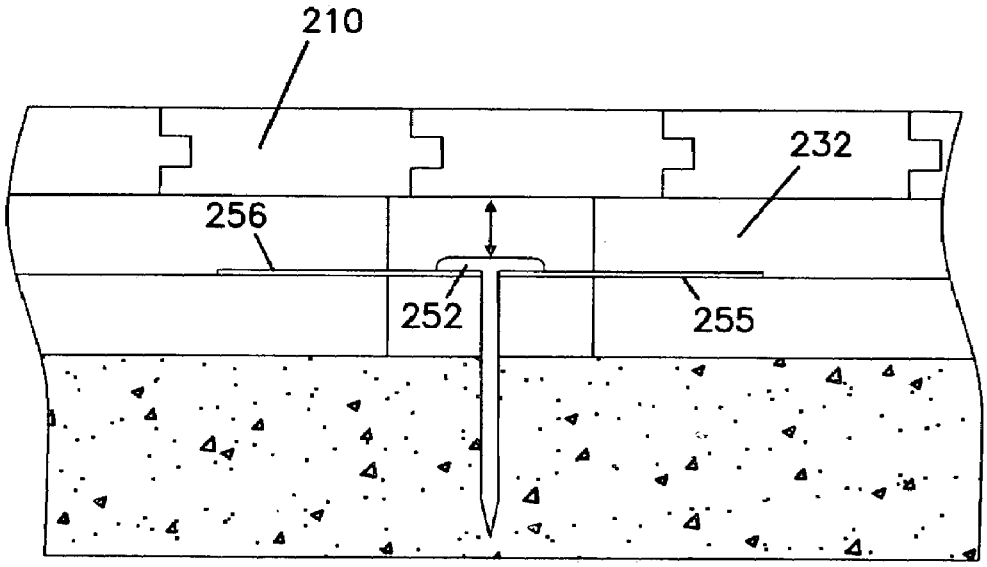
FIG. 6 is an elevation view of an alternative embodiment of an anchor arrangement according to the present disclosure.

In an alternative embodiment of an anchor arrangement, as is illustrated in FIG. 6, the anchor clip 255 may be made from a planar member 256 without a stepped section. A planar member can be used when the thickness of the upper plate 232 is large compared to the thickness of the anchor head 252, so that when the floor 210 is deflected it will not contact the anchor head 252. For example, the alternative anchor arrangement can be used when the upper plate is ½ inch thick and the anchor head is 3/16 inches thick. An advantage of the anchor arrangement of the present disclosure is that it can be installed into the subfloor when the subfloor sections are prefabricated for installation.

The present invention should not be considered limited to the particular examples described above, but rather should be understood to cover all aspects of the invention as fairly set out in the attached claims. Various modifications, equivalent processes, as well as numerous structures to which the present invention may be applicable will be readily apparent to those of skill in the art to which the present invention is directed upon review of the instant specification.

The invention claimed is:

1. A subfloor assembly for supporting a floor on a substrate, the subfloor assembly comprising:

a first subfloor including a plurality of first plates wherein each first plate has an associated recess that extends upwardly into the first plate from a lower surface of the first plate along an axis of the first plate and an associated ridge disposed in the recess which extends downwardly from a top surface of the recess to a height above the lower surface of the first plate;

a second subfloor including a plurality of second plates wherein the first subfloor is disposed underneath the second subfloor; and a resilient member located in each recess in contact with the ridge which extends downwardly from the top surface of the associated recess;

wherein the resilient elastic modulus of the resilient member results in the resilient member being spaced from the top surface of the recess from which the ridge downwardly extends when the first plate associated with the recess and the ridge is in an unloaded state and results in the resilient member deforming such that the resilient member contacts the top surface of the recess from which the ridge downwardly extends when the first plate associated with the recess and the ridge is in a loaded state.

2. The subfloor assembly of claim 1, further comprising a plurality of anchor pockets disposed through at least a portion of the first plates.

3. The subfloor assembly of claim 2, further comprising an adhesive layer disposed over the second subfloor.

4. The subfloor assembly of claim 1, wherein the resilient member is made from rubber, foam, or urethane.

5. The subfloor assembly of claim 1, wherein each recess is between 0.75 and 1.5 inches wide and each ridge is between 0.25 and 0.75 inches wide.

6. The subfloor assembly of claim 1, wherein the first and second plates of the first and second subfloor are aligned in a parallel orientation.

7. The subfloor assembly of claim 1, wherein each recess forms opposed side walls and the ridge associated with each recess is disposed within the recess so as to be spaced from both of the opposed side walls.

8. The subfloor assembly of claim 7, wherein the resilient material contacts the top surface of the recess proximate to each of the opposed side walls when the first plate associated with the recess is in the loaded state.

9. The subfloor assembly of claim 1, wherein the resilient member comprises a plurality of resilient pads, each of the plurality of resilient pads contacting the ridge associated with only one recess.

10. The subfloor assembly of claim 1, wherein the resilient member fills the recess when the first plate associated with the recess is in the loaded state.

11. A subfloor assembly for supporting a floor on a substrate, the subfloor assembly comprising:

a first subfloor including a plurality of first plates wherein each first plate has an associated recess that extends upwardly into the first plate from a lower surface of the first plate along an axis of the first plate and an associated ridge disposed in the recess which extends downwardly from a top surface of the recess to a height above the lower surface of the first plate;

a second subfloor including a plurality of second plates wherein the first subfloor is disposed underneath the second subfloor; and a resilient member located in each recess in contact with the ridge which extends downwardly from the top surface of the associated recess;

wherein the resilient elastic modulus of the resilient member results in the resilient member being spaced from the top surface of the recess from which the ridge downwardly extends when the first plate associated with the recess and the ridge is in an unloaded state and results in the resilient member deforming such that the resilient member moves into and lessens a volume of the recess from which the ridge downwardly extends when the first plate associated with the recess and the ridge is in a loaded state.

* * * * *